US007909713B2

(12) United States Patent
Davis et al.

(10) Patent No.: US 7,909,713 B2
(45) **Date of Patent: *Mar. 22, 2011**

(54) SHAFT FOR A SPORTS STICK SUCH AS A HOCKEY STICK

(75) Inventors: Stephen J. Davis, Newtown, PA (US); Roberto Gazzara, Mestre (IT); Mauro Pinaffo, Camposampiero (IT); Michele Pozzobon, Fossalunga Di Vedelago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/584,197

(22) Filed: Oct. 20, 2006

(65) Prior Publication Data

US 2007/0270253 A1 Nov. 22, 2007

(30) Foreign Application Priority Data

May 22, 2006 (EP) ..... 06114348

(51) Int. Cl.
*A63B 59/14* (2006.01)

(52) U.S. Cl. ..... 473/561

(58) Field of Classification Search ..... 473/560–568, 473/513, 316–321, 519, 520, 549–551
See application file for complete search history.

(56) References Cited

U.S. PATENT DOCUMENTS

| | | | | | |
|---|---|---|---|---|---|
| 59,313 | A | | 10/1866 | Hill | |
| 729,639 | A | | 6/1903 | McCoy | |
| 1,025,478 | A | | 5/1912 | Murphy | |
| 1,530,427 | A | | 3/1925 | Simon | |
| 2,033,722 | A | | 3/1936 | MacFarland | |
| 2,321,773 | A | | 6/1943 | Rumelin | |
| 3,377,066 | A | | 4/1968 | Trowbridge | |
| 3,392,976 | A | | 7/1968 | Hayes | |
| 4,086,115 | A | | 4/1978 | Sweet | |
| 4,124,208 | A | * | 11/1978 | Burns | 473/562 |
| 4,264,389 | A | | 4/1981 | Staub | |
| 4,358,113 | A | * | 11/1982 | McKinnon et al. | 473/561 |
| 4,600,193 | A | | 7/1986 | Merritt | |
| 4,795,153 | A | * | 1/1989 | Thomas | 473/316 |
| 4,931,247 | A | | 6/1990 | Yeh | |
| 5,082,279 | A | | 1/1992 | Hull | |
| 5,097,870 | A | | 3/1992 | Williams | |
| 5,153,798 | A | | 10/1992 | Ruigrok | |
| 5,179,255 | A | | 1/1993 | Yeh | |

(Continued)

FOREIGN PATENT DOCUMENTS

CA 2154370 3/1997

(Continued)

OTHER PUBLICATIONS

US 7,223,188, 05/2007, Davis (withdrawn)

*Primary Examiner* — Mark S Graham
(74) *Attorney, Agent, or Firm* — Abelman, Frayne & Schwab

(57) ABSTRACT

A handle is adapted to be held by a player and a striking end is adapted to contact and propel an object A structure for a hockey stick is described by using multiple composite tubes bonded to one another, wherein apertures, or "ports," are molded between the tubes to improve the stiffness, strength, aerodynamics and comfort of the hockey stick.

7 Claims, 6 Drawing Sheets

U.S. PATENT DOCUMENTS

| | | | | |
|---|---|---|---|---|
| 5,249,846 | A | 10/1993 | Martin | |
| 5,285,008 | A * | 2/1994 | Sas-Jaworsky et al. | 174/47 |
| 5,301,940 | A | 4/1994 | Seki | |
| 5,303,916 | A | 4/1994 | Rodgers | |
| 5,419,553 | A | 5/1995 | Rodgers | |
| 5,636,836 | A | 6/1997 | Carroll | |
| 5,746,955 | A | 5/1998 | Calapp | |
| 5,766,104 | A | 6/1998 | Albarelli | |
| 5,865,696 | A | 2/1999 | Calapp | |
| 5,879,250 | A * | 3/1999 | Tahtinen et al. | 473/561 |
| 5,975,645 | A | 11/1999 | Sargent | |
| 6,042,493 | A | 3/2000 | Chauvin | |
| 6,086,161 | A | 7/2000 | Luttgeharm | |
| 6,113,508 | A * | 9/2000 | Locarno et al. | 473/516 |
| 6,129,962 | A * | 10/2000 | Quigley et al. | 428/36.1 |
| 6,241,633 | B1 | 6/2001 | Conroy | |
| 6,383,101 | B2 | 5/2002 | Eggiman | |
| 6,485,382 | B1 | 11/2002 | Chen | |
| 6,663,517 | B2 | 12/2003 | Buiatti | |
| 6,723,012 | B1 | 4/2004 | Sutherland | |
| 6,761,653 | B1 | 7/2004 | Higginbotham | |
| 6,764,419 | B1 | 7/2004 | Giannetti | |
| 6,776,735 | B1 | 8/2004 | Belanger | |
| 6,800,239 | B2 | 10/2004 | Davis | |
| 6,808,464 | B1 | 10/2004 | Nguyen | |
| 6,866,598 | B2 | 3/2005 | Giannetti | |
| 6,872,156 | B2 | 3/2005 | Ogawa | |
| 7,014,580 | B2 | 3/2006 | Forsythe | |
| 7,207,907 | B2 | 4/2007 | Guenther | |
| 7,309,299 | B2 | 12/2007 | Pezzato | |
| 7,396,303 | B2 | 7/2008 | Gazzara | |
| 2003/0104152 | A1 | 6/2003 | Sommer | |
| 2003/0162613 | A1 | 8/2003 | Davis | |
| 2004/0048683 | A1 | 3/2004 | Burrows | |
| 2004/0102256 | A1 * | 5/2004 | Kumamoto | 473/319 |
| 2004/0198538 | A1 | 10/2004 | Goldsmith | |
| 2004/0198539 | A1 | 10/2004 | Sutherland | |
| 2005/0062337 | A1 | 3/2005 | Meggiolan | |
| 2005/0153799 | A1 * | 7/2005 | Rigoli | 473/513 |
| 2005/0164814 | A1 | 7/2005 | Tucker | |
| 2005/0221924 | A1 | 10/2005 | Sutherland | |
| 2006/0122013 | A1 | 6/2006 | Dodge | |
| 2006/0247077 | A1 | 11/2006 | Deetz | |
| 2007/0123376 | A1 | 5/2007 | Gazzara | |
| 2007/0135245 | A1 | 6/2007 | Gazzara | |
| 2007/0200422 | A1 | 8/2007 | Davis | |
| 2007/0222178 | A1 | 9/2007 | Davis | |
| 2007/0238560 | A1 | 10/2007 | Gazzara | |
| 2007/0293344 | A1 | 12/2007 | Davis | |

FOREIGN PATENT DOCUMENTS

| | | |
|---|---|---|
| CA | 2231908 | 9/1999 |
| DE | 4415509 | 11/1995 |
| EP | 1859838 | 11/2007 |
| EP | 1859839 | 11/2007 |
| JP | 53038431 | 4/1978 |
| JP | 02255164 | 10/1990 |
| JP | 05015624 | 1/1993 |
| JP | 09117968 | 5/1997 |
| JP | 11276652 | 10/1999 |
| JP | 2000-042155 | 2/2000 |
| WO | WO 84/03447 | 9/1984 |
| WO | WO 94/26361 | 11/1994 |
| WO | WO 00/09219 | 2/2000 |
| WO | WO 01/26752 | 4/2001 |
| WO | WO0126752 | 4/2001 |
| WO | WO 03/076176 | 9/2003 |
| WO | WO 2004/075996 | 9/2004 |

* cited by examiner

SHAFT FOR A SPORTS STICK SUCH AS A HOCKEY STICK

RELATED APPLICATIONS

This application claims priority under 35 U.S.C. §119 to European Patent Application EP06114348, filed May 22, 2006. This application is also a continuation-in-part of co-pending U.S. application Ser. No. 11/752,574, entitled "Composite Hockey Stick System", filed May 23, 2007, which is a continuation of U.S. application Ser. No. 11/183,585, filed Jul. 18, 2005, now abandoned.

BACKGROUND OF THE INVENTION

The present invention relates to a composite structure for a hockey stick.

Hockey stick systems have traditionally been made from wood. Wood has been a convenient and traditional material to use but is limited in strength and weight. The wood stick is solid and can be made from a multi ply lamination in order to improve strength.

Recent developments have improved hockey sticks by making them out of metal such as aluminum. Such sticks are typically made from a one piece extruded aluminum tube to which can be attached a blade and handle. The tubular construction offers a lighter weight and also easy attachment for the blade and handle.

More recent developments have advanced hockey stick performance by using composite materials such as fiber reinforced resins such as carbon fiber in an epoxy resin. These sticks are tubular in form to maximize strength and minimize weight.

Composite materials are attractive alternatives to wood, because there exists a large selection of fiber types and resin types, the combinations of which can produce a multitude of options suitable for replacement to wood. These composite laminates have the advantage of being stiffer, stronger, and less susceptible to environmental changes than wood.

One of the first patents describing composite materials used for hockey sticks is U.S. Pat. No. 4,086,115 to Sweet which discloses a tubular hockey stick manufactured using fiberglass fibers in a polyester resin made using a pultrusion process.

U.S. Pat. Nos. 5,419,553 and 5,303,916 to Rogers disclose an improved hockey stick made from composite materials, also made using the pultrusion process, with the addition of specific fiber orientation in order to improve the stiffness and strength of the stick.

The pultrusion process has also been used to create a hockey stick of two tubes with an internal wall in between. U.S. Pat. Nos. 5,549,947, 5,688,571, 5,888,601, 6,129,962 to Quigley, et. al., describe a continuous manufacturing operation to produce a hockey stick with continuous fiber reinforcement. The limitations of making a hockey stick using a pulltrusion process are that fiber placement cannot be changed along the length of the structure and the cross-section cannot be varied along its length.

U.S. Pat. No. 5,636,836 to Carroll, No. 5,746,955 to Calapp, No. 5,865,696 to Calapp, and No. 6,241,633 to Conroy all describe tubular hockey stick systems made from fiber reinforced resin materials with specific fiber orientation in order to achieve desired performance characteristics.

There exists a continuing need for an improved hockey stick system. In this regard, the present invention substantially fulfills this need.

SUMMARY OF THE INVENTION

The present invention is a hockey stick where the structure is generally tubular and the traditional single tube is replaced with multiple continuous tubes, preferably a pair of tubes fused together along their facing surfaces to provide an internal reinforcing wall as well as apertures, or "ports," between the tubes to provide specific performance advantages.

In particular, the basis of the design is to replace a single tube portion with a double tube design while maintaining the same or similar geometric exterior shape of the original single circular tube design. This provides a structure with an internal wall between the tubes which has strength and stiffness advantages. In addition, the tubes can be separated at various locations to form apertures or ports between the tubes which act as opposing arches which provide additional strength, stiffness, comfort, and aerodynamic benefits.

The hockey stick system according to the present invention substantially departs from the conventional concepts and designs of the prior art and in doing so provides an apparatus primarily developed for the purpose of improved aerodynamics, strength and appearance.

The present invention is designed to provide a combination of tailored stiffness, greater strength, light weight, greater comfort, improved aerodynamics, and improved aesthetics over the current prior art.

In view of the foregoing commonality inherent in the known types of hockey sticks of known designs and configurations now present in the prior art, the present invention provides an improved hockey stick system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The present invention provides a new and improved hockey stick system which may be easily and efficiently manufactured.

The present invention provides a new and improved hockey stick system which is of durable and reliable construction.

The present invention provides a new and improved hockey stick system which may be manufactured at a low cost with regard to both materials and labor.

The present invention further provides a hockey stick system that can provide specific stiffness zones at various orientations and locations along the length of the shaft.

The present invention provides an improved hockey stick system that has superior strength and fatigue resistance.

The present invention provides an improved hockey stick system that has improved shock absorption and vibration damping characteristics.

The present invention provides an improved hockey stick system that has improved aerodynamics.

The present invention provides an improved hockey stick system that has a unique look and improved aesthetics.

Lastly, the present invention provides a new and improved hockey stick system made with a multiple tube design, where the tubes, which are fused together along much of their lengths, are separated from one another at selected locations to form apertures that act as double opposing arches, providing improved means of adjusting stiffness, resiliency, strength, comfort, and aerodynamics.

For a better understanding of the invention and its advantages, reference should be made to the accompanying drawings and descriptive matter in which there are illustrated preferred embodiments of the invention.

BRIEF DESCRIPTION OF THE DRAWINGS

The same reference numerals refer to the same parts throughout the various Figures.

DETAILED DESCRIPTION OF THE INVENTION

Figure 1:
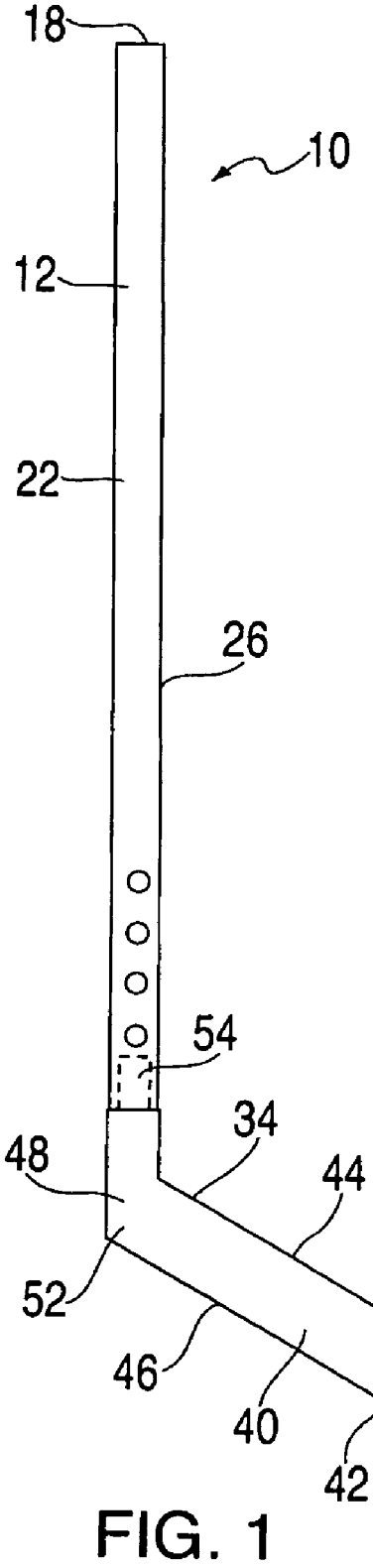
FIG. 1 is a front elevational view of a hockey stick system, shaft and blade, constructed in accordance with the principles of the present invention.
Figure 2:
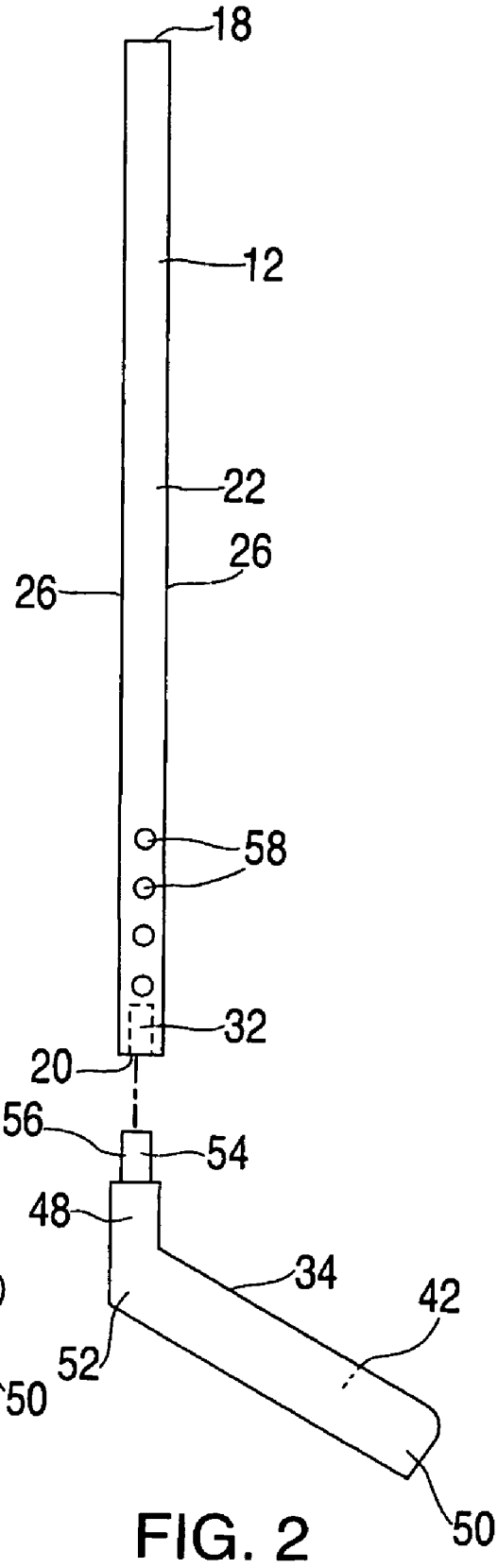
FIG. 2 is an exploded front elevational view of the hockey stick system shown in FIG. 1.

With greater reference to FIGS. 1 through 6 of the drawings, the present invention is a composite hockey stick system 10. The system features geometric shapes in the shaft for improving the flexibility, strength and other playing characteristics of the system. The system comprises a handle 12 and a striking end 34, i.e., a blade. As exemplified in FIG. 6, the stick handle 12 is fabricated of multiple layers of aligned carbon filaments 14 and 36 held together with an epoxy binder 16. The fibers in the various plies are parallel to one another, but the various plies preferably have varying fiber orientations.

Figure 3:
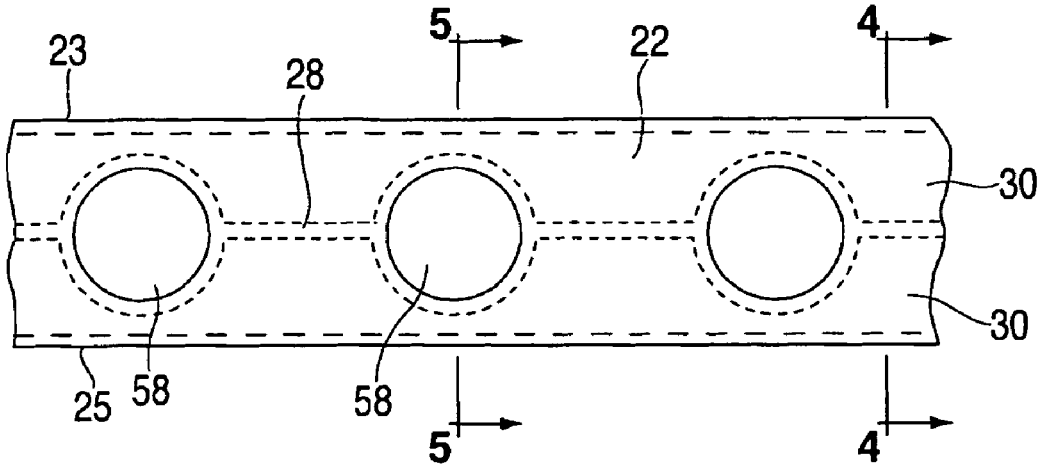
FIG. 3 is an enlarged front elevational view of the hockey stick system shown in FIG. 1 illustrating the holes in greater detail.
Figure 4:
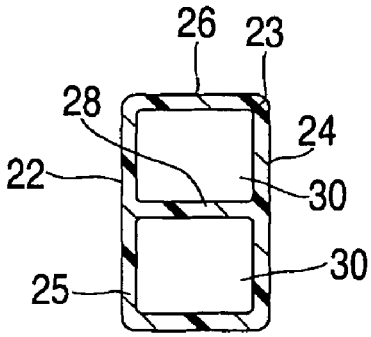
FIGS. 4 and 5 are cross sectional views taken along lines 4-4 and 5-5 of in FIG. 3.

The stick handle 12 has a long generally hollow rectangular configuration with a top end 18, a bottom end 20, a front face 22, a bottom face 24, and a pair side faces 26. As shown in FIGS. 3-4, the stick handle has a central wall 28 running vertically and generally parallel with the side faces forming two adjacent tubes 30 with hollow interiors along the extent of the stick handle end. The stick has a recessed opening 32 in the bottom end 20 thereof.

Figure 6:
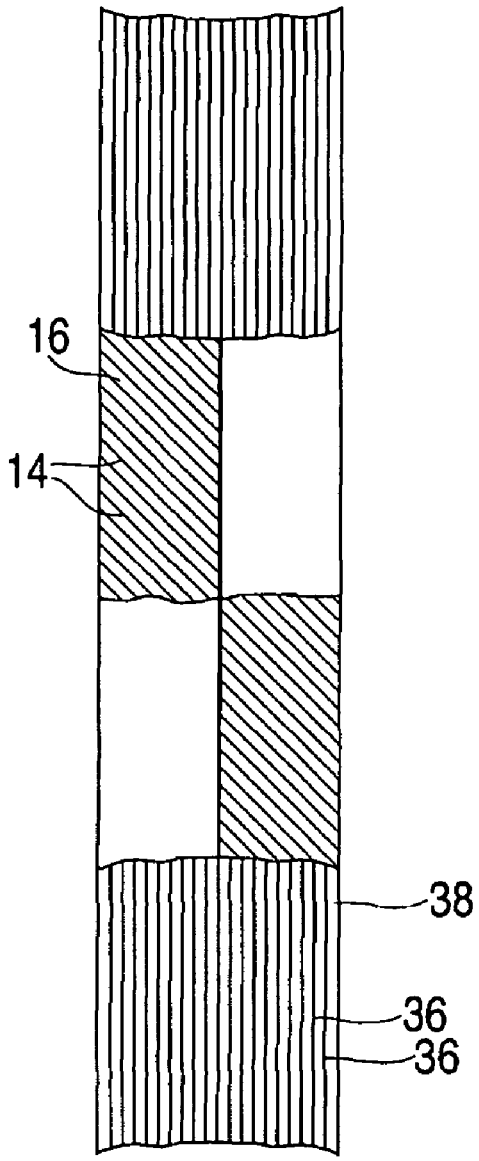
FIG. 6 is an isometric view of a portion of the shaft showing the various laminates used.

The stick striking end 34 is preferably also fabricated of multiple layers of aligned carbon filaments 14 and 36 held together with an epoxy binder 38, as illustrated by generally FIG. 6 (however, the plies of the blade may have different fiber orientations than the handle).

The stick striking end 34 has a generally thin rectangular configuration with a first face 40, a second face 42, an upper edge 44, a lower edge 46, a near end 48, and a far end 50. The near end has a bend 52 at an angle between 45 degrees and 80 degree and being preferably 65 degrees measured between the side faces of the stick handle end and the upper edge and the lower edge. The bottom end 20 of the stick handle end has a male fitting 54 extending outwardly therefrom, with the fitting 54 being adapted to couple into the opening in the bottom end of the stick handle end.

An adhesive 56 couples the stick handle with the stick striking end between the connecting bar and the opening in the stick handle end.

The stick handle end and the stick striking end are configured together to form a shaft which is generally linear in shape.

A plurality of oval apertures 58 are formed in the stick handle, preferably near the bottom end 20. The apertures extend between the front face and the bottom face. Each aperture is preferably oval in shape, with the long axis of the oval in line with the vertical axis of the shaft. Each aperture includes an interior wall defining an associated hole. The apertures separate the adjacent portions of the tubes of the shaft creating openings of increased surface area.

Figure 5:
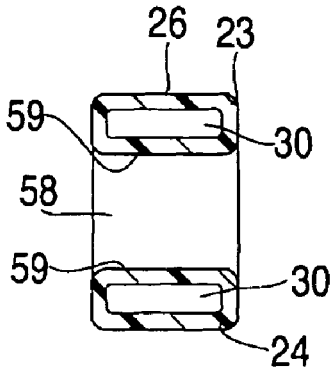

In the exemplary embodiment shown in FIGS. 3-5, the handle 12 is formed of two tubes 23 and 25, in a process described further below. Portions of the two tubes 23, 25 form an outer wall of the handle 12. In addition, other portions of the tubes bond together, forming the interior wall 28. However, at the locations of the openings 58, the facing surfaces 59 of the two tubes 23, 25 are separated from one another, thereby forming the openings 58.

In the embodiment of FIGS. 1-5, the interior wall 28 and openings 58 are oriented in the direction in which the hockey stick is swung. Alternatively, the interior wall 28 and openings 58 may be oriented perpendicular to such direction.

Figure 9:
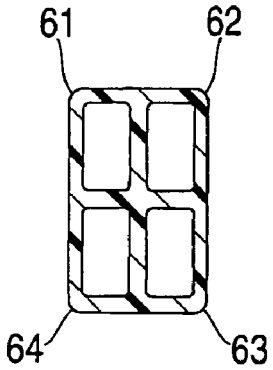
FIG. 9 is a cross-section of a handle which is formed of four tubes, corresponding to the location of FIG. 4.
Figure 10:
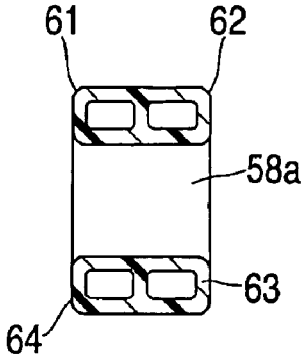
FIG. 10 is a cross-section of the handle of FIG. 9, corresponding to the location of FIG. 5.
Figure 11:
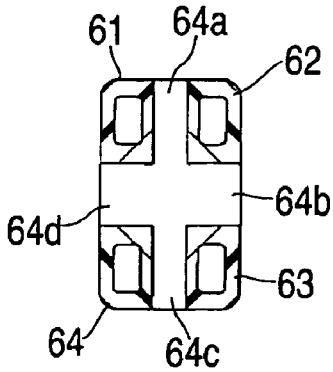
FIG. 11 is a cross-section of the handle of FIG. 9, corresponding to the location of FIG. 5, showing an alternate embodiment.

Also, the handle may be formed with more than two tubes. For example, the handle may be formed with four tubes, as shown in FIG. 9. As shown, four tubes 61, 62, 63, 64 form interior reinforcement walls that extend both in the direction of the swing and perpendicular to such direction. Using four tubes provides the option of forming apertures 58*a* either in the direction of the swing, as shown in FIG. 10, by separating tubes 61 and 62 from tubes 63, 64, or perpendicular to such direction (by separating tubes 61 and 64 from tubes 62 and 63). If desired, four apertures 64*a*-3 may be formed, as shown in FIG. 11, by separating all of tubes from one another.

Figure 7:
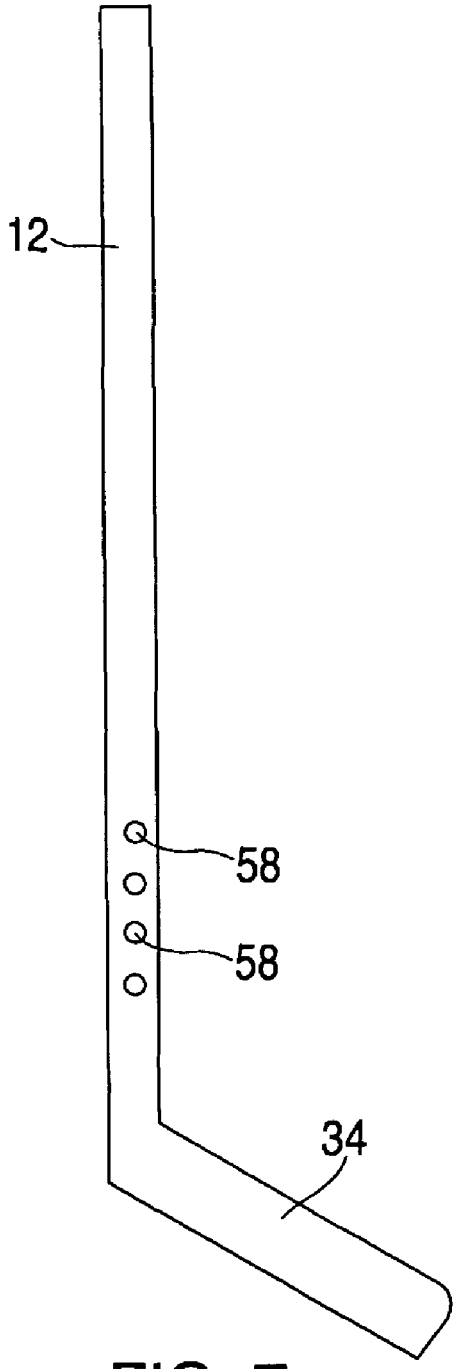
FIG. 7 is a front elevational view of a hockey stick system, shaft and blade, constructed in accordance with an alternate embodiment of the present invention.

An alternate embodiment of the invention is illustrated in FIG. 7. Such embodiment is a one piece hockey stick with its handle stick 12 and striking stick end 34 fabricated with apertures 58 there through. In this alternative embodiment the hockey stick is preferably made of metal, preferably aluminum. It is understood that this embodiment could also be constructed of a composite. Likewise the two piece embodiment although shown as a composite in the FIGS. 1-5 could also be make of metal.

As described below, the hockey stick is formed of two or more tubes which are molded together. Along most of the length of the handle 12, portions of the tubes fuse together during molding to form the common wall 28 (or walls, in the case of more than two tubes). However, at selected locations, the facing surfaces 59 of the tubes are kept apart during molding, to form the openings 58. As shown in FIG. 5, on either side of the openings 58, the tubes are joined together. The openings 58 so formed are referred to herein as "ports." These ports are formed without drilling any holes or severing any reinforcement fibers.

The resulting structure is found to have superior performance characteristics for several reasons. The ports are in the shape of double opposing arches which allow the structure to deflect which deforms the ports, and return with more resiliency. The ports also allow greater bending flexibility than would traditionally be achieved in a single tube design. The internal wall between the internal tubes adds strength to resist compressive buckling loads. The structure can also improve comfort by absorbing shock and damping vibrations due to the deformation of the ports. Finally, the ports can improve aerodynamics by allowing air to pass through the shaft to reduce the wind resistance and improve maneuverability.

Pultrusion processes are not suitable for use in making the present invention because of the geometric change in shaft design along the length of the shaft. Traditional composite hockey stick systems are constant in cross sectional shape and have a continuous wall. With the present invention, apertures are molded at multiple locations along the length of the shaft therefore requiring a specific molding technique.

Each tube is preferably made from a long fiber reinforced prepreg type material. Traditional lightweight composite structures have been made by preparing an intermediate material known as a prepreg which will be used to mold the final structure.

A prepreg is formed by embedding the fibers, such as carbon, glass, and others, in resin. This is typically done using a prepreg machine, which applies the non-cured resin over the fibers so they are all wetted out. The resin is at an "B Stage" meaning that only heat and pressure are required to complete the cross linking and harden and cure the resin. Thermoset resins like epoxy are popular because they are available in liquid form at room temperature, which facilitates the embedding process.

A thermoset is created by a chemical reaction of two components, forming a material in a nonreversible process. Usually, the two components are available in liquid form, and after mixing together, will remain a liquid for a period of time before the crosslinking process begins. It is during this "B Stage" that the prepreg process happens, where the resin coats the fibers. Common thermoset materials are epoxy, polyester, vinyl, phenolic, polyimide, and others.

The prepreg sheets are cut and stacked according to a specific sequence, paying attention to the fiber orientation of each ply, as illustrated generally by FIG. 6. Generally is it desirable to have a symmetrical sequence, meaning that in the final laminate, the same fiber orientation is present above and below the centerline of the laminate, at the same distance. Each ply will have a specific fiber orientation depending on the performance required.

Each prepreg layer comprises an epoxy resin combined with unidirectional parallel fibers from the class of fibers including but not limited to carbon fibers, glass fibers, aramid fibers, and boron fibers.

The prepreg is cut into strips at various angles and laid up on a table. The strips are then stacked in an alternating fashion such that the fibers of each layer are different to the adjacent layers. For example, one layer may be +30 degrees, the next layer −30 degrees. If more bending stiffness is desired, a lower angle such as 20 degrees can be used. If more torsional stiffness is desired, a higher angle such as 45 degrees can be used. In addition, 0 degrees can be used for maximum bending stiffness, and 90 degrees can be used to resist impact forces and to maintain the geometric structural shape of the tube.

This layup, which comprises various strips of prepreg material, is then rolled up into a tube. A thin walled polymeric bladder is then inserted into the tube. This bladder will be used to internally inflate the tube when placed in the mold.

Another similar tube is prepared. The two tubes are then packed into a mold which forms the shape of the hockey stick. The two tubes are positioned side by side so that the common wall between the tubes is the short dimension of the rectangular shaped cross section of the shaft. If the mold and tubes are longer than the final desired dimension of the hockey stick, a final cut to length operation can be performed on the handle 12 after molding.

Air fittings are applied to the interior of the bladder on each end of each tube. The mold is then closed over the tubes and placed in a heated platen press. For epoxy resins, the temperature is typically around 350 degrees F. While the mold is being heated, the tubes are internally pressurized which compresses the prepreg material and cures the epoxy resin. Once cured, the mold is opened and the part is removed.

If apertures or spaces between the tubes are desired, then the mold must have provisions for such. The mold will have pins positioned in the mold, between the two tubes, to keep the tubes separated and thereby to form these openings. The pins can be positioned using side plates in the mold. The procedure would be to pack the first tube into the bottom part of the mold. Then, the side plates with the pins are positioned over the tube. The second tube is then placed over the pins. Finally, the top portion of the mold is positioned and the mold is closed. If desired, additional reinforcement can be wrapped around each pin prior to placing in the mold.

When the mold is heated up and air pressure is applied, the prepreg material becomes soft and conforms around each pin. Once cured, the mold is opened in the reverse sequence of packing. The top portion of the mold is removed, then the side plates are removed. Particular attention is needed when removing the side plates and pins to ensure that all pins are pushed out in a linear fashion. Once the pins are removed from the part, the part can be removed from the bottom portion of the mold.

The composite material used is preferably carbon fiber reinforced epoxy because the objective is to provide reinforcement at the lightest possible weight. Other fibers may be used such as fiberglass, aramid, boron and others. Other thermoset resins may be used such as polyester and vinyl ester. Thermoplastic resins may also be used such as nylon, ABS, PBT and others.

The resulting structure is unlike any hockey stick ever made. First of all, the internal wall adds strength because it helps prevent the tube from collapsing during bending. Hollow tubes are susceptible to buckling failure when being flexed to extreme amounts. This is because when being flexed, a portion of the tube is under compressive forces, and the thin wall of the tube will buckle. With the internal wall, this significantly improves flexural strength by preventing the wall of the tube from buckling.

The hockey stick system of the present invention becomes even more unique when the apertures are molded in the structure. It is not necessary to change the exterior dimensions of the shaft when molding apertures. Therefore, the shaft becomes much more aerodynamic because the frontal area is significantly reduced. This is a great benefit to a hockey stick system. The hockey stick is long in length and can be difficult to generate fast swing speeds. For example, compared to a golf shaft which is about the same length, the hockey stick system is about four times to about six times greater in frontal area, therefore being much less aerodynamic.

Having aerodynamic apertures in the hockey shaft can significantly reduce aerodynamic drag. The size and spacing of each aperture can vary according to desired performance parameters. The orientation, or axis of the apertures is in line with the swing direction of the shaft therefore maximizing the aerodynamic benefit.

The size and spacing of the apertures can affect shaft stiffness in a desirable way. These apertures can direct the flex-point of the shaft toward the lower portion of the shaft if desired. A hockey stick system with a lower flex point is said to provide more velocity to the shot.

An unexpected benefit of the apertures in the shaft is that they actually improve the durability and strength of the shaft. This is because they act as arches to distribute the stress and strain in a very efficient manner. This is because during a typical hockey shot, the blade of the hockey stick contacts the ice with significant force, which induces an "out of plane" bending on the shaft. The molded apertures in the shaft allow more flex in this direction which can improve the fatigue resistance of the shaft.

A design modification is used in order to bond a hockey shaft of the present invention to a typical blade. A typical hockey blade a fitting 54 that fits inside the lower end 20 of the handle 12. The fitting 54 would not fit if the internal wall 28 were to extend all the way to the lower end 20. Therefore, it is necessary to modify the internal structure in the region of the lower end 20 in order to receive the fitting 54. This can be done several ways.

One option is to have two different prepreg tube lengths. One tube would be the full length of the shaft, and the other would start at a point some distance from one end and then continue to the full length of the other end. The joint area where the shorter tube connects to the longer tube will typically require extra reinforcement which is not a problem with fiber reinforced composites.

Figure 4A:
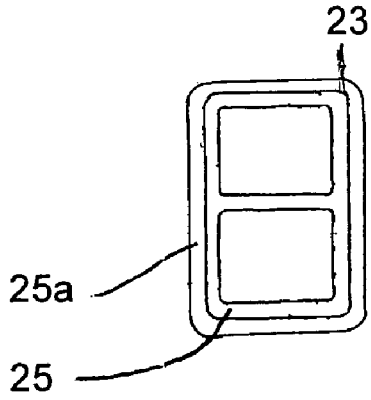
FIG. 4*a* is an end view of a shaft containing three tubes.

A second option is to manufacture the hockey shaft of the present invention using three tubes, as shown in FIG. 4*a*. Two tubes 23 and 25 will be of equal construction and length. Both will be slightly shorter than the full length of the shaft. Then a third tube 25*a* is positioned over both tubes on one end. The bladders of both internal tubes continue out the back of the third tube. When inflated, the bladders will compress each of the longer tubes as well as the over wrapped third tube creating a unified structure. Again, as with the first option, additional reinforcement may be required in this joint region.

A third option is to use a coupling, or a third part sleeve, to bond the hockey shaft of the present invention to the blade. In this case, the tip region of the shaft shall be molded of an exterior shape equal to that of the blade portion. Then a tubular sleeve of short length can be positioned over both the blade portion and shaft portion and bonded into place.

Figure 8:
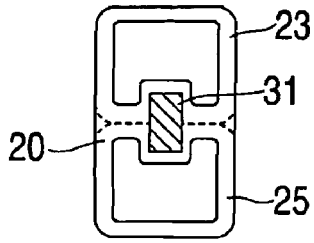
FIG. 8 is an end view of the bottom of the handle of an embodiment of the invention, after being removed from the mold.

A fourth option is illustrated in FIG. 8. As shown there, during molding, a socket-forming member 31 is inserted between the tubes 23, 25 in the longitudinal direction. The socket forming member 31 extends up between the tubes 23, 25 for a distance which is at least as long as the fitting 54. After molding, the member 31 is withdrawn, leaving the socket 32. Although the member 31 is shown as having a generally rectangular cross section, any cross-sectional shape may be used, provided it corresponds to the cross-section of the fitting 54.

Figure 12:
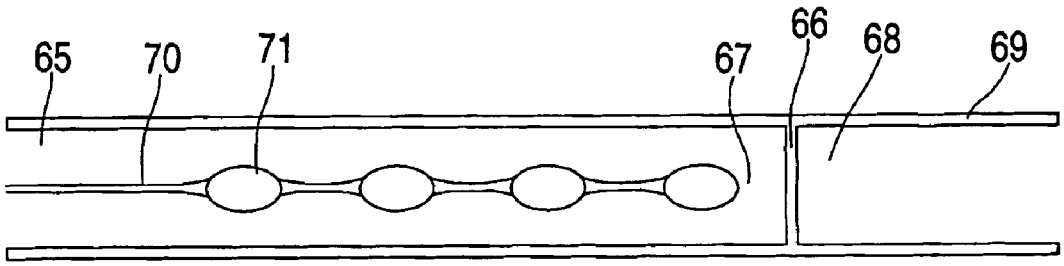
FIG. 12 is a longitudinal cross-section of the handle in the port area showing an alternate construction.

A fifth option is shown in FIG. 12 which shows a longitudinal cross section of the shaft in the port area. Here, a single long tube 65 begins at the upper end of the handle, continues toward the lower end and once past the last port, reverses direction and returns back to the upper end on the other side of the ports. This creates a "hairpin" shaped tube where the "U" portion of the hairpin forms an internal wall 66 creating an interface between the ported area 67 and the lower blade receiving area 68. The blade receiving area 68 is formed by a single tube 69 which has an internal geometry to accept the fitting 54.

The internal wall 70 formed in the handle area can vary in length outside the port area. For example, the internal wall 70 can terminate shortly after the first port 71, leaving a single tube for the remaining portion of the shaft.

It is also possible to design the blade attachment means using two male protrusions, each of which would be positioned into each of the tube regions of the hockey shaft.

A hockey stick system of the present invention can be molded as a one piece structure with the blade portion attached, therefore producing an entire hockey stick. In this case, there is no joint between the shaft and the blade. The stick is made with longer prepreg tubes which are joined to the blade construction prior to molding. The entire stick with all components (shaft and blade) are molded together in one operation. It is also possible to have a precured blade, which is then placed in a mold for bonding to the prepreg shaft as it is cured. It is also possible to have a precured (or molded) shaft and blade, then place both into a mold with prepreg reinforcements wrapped around the joint or interface between the shaft and blade in order to make a one piece unit.

The present invention can also be molded from 4 tubes, with each tube occupying a quadrant of the hockey shaft cross section. This design allows the flexibility of creating ports in two directions: in line with the direction of travel of the blade for aerodynamic purposes, and perpendicular to the direction of travel of the blade for flexibility purposes. With this design, it is also possible to locate both orientations of ports in the same location to give a truss like appearance to the hockey shaft.

Another alternative is to use an extruded aluminum (or other metal) tube for the shaft that is partial length, and then join this to the dual tube shaft that has the apertures. Specifically, the aluminum tube would start at the handle end, and then join to the carbon fiber tube somewhere along the length of the shaft depending on how many apertures were desired. This provides a low cost alternative to the full length carbon fiber design.

The hockey stick system of the present invention is not limited to ice hockey stick systems. The shaft of the ice hockey stick as described can also be used for field hockey sticks, roller hockey sticks, lacrosse sticks and polo mallets, and many other sports-related implements having a shaft coupled to specialized functional attachment. When configured as a shaft for other types of sporting implements, the shaft may be required to have a cross sectional shape other than rectangular, for example, a cross sectional shape suitable to lacrosse sticks or the cross sectional shape associated with polo mallets, which is typically circular. All such shapes and uses of the shaft are contemplated to be within the scope of the invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A shaft for a sports stick, comprising two hollow tubes, each tube having a length, the tubes being coextensive and having facing surfaces along their length;

wherein portions of said facing surfaces are fused together along fused portions to form an integral interior wall of the shaft, and wherein said tubes have non-facing surfaces which form external surfaces of the shaft;

wherein the external surface of one tube adjoins the external surface of the other tube on opposite sides of said shaft to define a hollow interior of the shaft, and wherein said interior wall extends from adjoining external surfaces of said hollow tubes on one side of said shaft, through the hollow interior of the shaft, to adjoining exterior surfaces of said hollow tubes on an opposite side of said shaft;

wherein said facing surfaces are separated from one another at one or more locations between fused portions such that the walls of the facing surfaces at the separated locations define one or more apertures which extend through the shaft in a direction at least generally perpendicular to the longitudinal axis, the apertures being defined by separated, facing surfaces of the tubes, wherein said apertures are formed without forming holes through either tube; and wherein the facing surfaces of the two or more tubes comprise a composite material including a plurality of fiber layers, the composite material extending continuously along said fused portions and the one or more locations at which the facing surfaces are separated to form one or more apertures.

2. The sports stick of claim 1, wherein said facing surfaces of said tubes are separated from one another at a plurality of locations along the length of the shaft so as to form multiple apertures through said shaft.

3. The sports stick of claim 2, wherein each of said one or more apertures has an axis, and further wherein the axes of at least two apertures are parallel to one another.

4. The sports stick of claim 1, wherein said shaft further includes a third tube of composite material disposed around, and bonded to, said exterior surfaces.

5. A hockey stick comprising:

a shaft formed of four hollow tubes, each tube having a length, the tubes being coextensive;

wherein each tube has a pair of facing surfaces along its length, wherein portions of said facing surfaces of each tube are fused together along fused portions with corresponding portions of facing surfaces of two other tubes to form integral interior walls of the shaft, and wherein said tubes have non-facing surfaces which form external surfaces of the shaft, wherein the external surface of each tube adjoins the external surface of two other tubes to define a hollow interior of the shaft, and wherein said interior walls extend from adjoining external surfaces of said hollow tubes on one side of said shaft, through the hollow interior of the shaft, to adjoining exterior surfaces of said hollow tubes on an opposite side of said shaft;

wherein at least two of said facing surfaces are separated from one another at one or more locations between fused portions such that the walls of the facing surfaces at the separated locations define one or more apertures which extend through the shaft in a direction at least generally perpendicular to the longitudinal axis, the apertures being defined by separated, facing surfaces of the tubes, wherein said apertures are formed without forming holes through the tubes; and wherein the facing surfaces of the tubes comprise a composite material including a plurality of fiber layers, the composite material extending continuously along said fused portions and the one or more locations at which the facing surfaces are separated to form one or more apertures; and a striking end secured to one end of said shaft.

6. The hockey stick of claim 5, wherein portions of said facing surfaces are separated from one another at a plurality of locations along the length of the shaft so as to form multiple apertures extending through said shaft at an angle generally perpendicular to the longitudinal axis.

7. The hockey stick of claim 5, wherein portions of said facing surfaces of all four tubes are separated from one another at the same axial location of said shaft to form a pair of apertures through the shaft which are perpendicular to one another.

* * * * *